US011339587B2

(12) United States Patent
Gustavsson

(10) Patent No.: US 11,339,587 B2
(45) Date of Patent: May 24, 2022

(54) LOCK CASSETTE AND SAFETY DOOR

(71) Applicant: CESIUM AB, Katrineholm (SE)

(72) Inventor: Jack Gustavsson, Katrineholm (SE)

(73) Assignee: Cesium AB, Katrineholm (SE)

( * ) Notice: Subject to any disclaimer, the term of this patent is extended or adjusted under 35 U.S.C. 154(b) by 406 days.

(21) Appl. No.: 16/305,919

(22) PCT Filed: Jun. 2, 2017

(86) PCT No.: PCT/SE2017/050592
§ 371 (c)(1),
(2) Date: Nov. 30, 2018

(87) PCT Pub. No.: WO2017/209687
PCT Pub. Date: Dec. 7, 2017

(65) Prior Publication Data

US 2020/0332556 A1 Oct. 22, 2020

(30) Foreign Application Priority Data

Jun. 3, 2016 (SE) ..... 1650779-0

(51) Int. Cl.
*E05B 59/00* (2006.01)
*E05B 17/20* (2006.01)
*E05C 9/04* (2006.01)

(52) U.S. Cl.
CPC ..... *E05B 17/2092* (2013.01); *E05B 59/00* (2013.01); *E05C 9/047* (2013.01); *E05Y 2900/132* (2013.01)

(58) Field of Classification Search
CPC ..... E05B 17/2092; E05B 59/00; E05C 9/047; E05Y 2900/132
(Continued)

(56) References Cited

U.S. PATENT DOCUMENTS 1,350,766 A 8/1920 Ailes
2,923,536 A 2/1958 Watson
(Continued)

FOREIGN PATENT DOCUMENTS

CN 2469133 Y 1/2002
CN 2605355 Y 3/2004
(Continued)

OTHER PUBLICATIONS

Chinese Official Action (dated May 19, 2020) for corresponding Chinese App. 201780048472.6.
(Continued)

*Primary Examiner* — Suzanne L Barrett
(74) *Attorney, Agent, or Firm* — WRB-IP LLP

(57) ABSTRACT

A lock cassette includes at least one lock bolt connecting piece, adapted for releasable engagement with a lock cassette engaging end portion of a door integrated lock bolt of a door when the lock cassette is mounted in a lock cassette receiving cavity of the door, a lock bolt maneuvering mechanism, configured to displace the at least one lock bolt connecting piece between an extended position and a retracted position, to thereby displace the lock bolt between an extended position and a retracted position, and at least one lock bolt locking arrangement, configured to lock the movability of the at least one lock bolt connecting piece when a locking action is effected, and unlock the movability of the at least one lock bolt connecting piece when an unlocking action is effected.

14 Claims, 3 Drawing Sheets

(58) Field of Classification Search
USPC ..... 70/1.5, 103, 108, 333 R, 416, 422
See application file for complete search history.

(56) References Cited

U.S. PATENT DOCUMENTS

| | | | | |
|---|---|---|---|---|
| 2,947,160 | A * | 8/1960 | Wolters | E05B 65/0082 70/1.5 |
| 2,996,322 | A | 8/1961 | McClellan | |
| 3,076,420 | A * | 2/1963 | McClellan | E05B 65/0082 109/38 |
| 4,147,044 | A * | 4/1979 | Bernath | E05B 65/0082 292/36 |
| 4,154,070 | A | 5/1979 | Bahry et al. | |
| 4,168,616 | A | 9/1979 | Goldman | |
| 4,266,488 | A * | 5/1981 | Markham | E05B 65/0082 109/59 R |
| 4,679,415 | A * | 7/1987 | Spratt | E05B 65/0075 109/59 R |
| 4,754,629 | A * | 7/1988 | Allen | E05B 47/0603 109/42 |
| 5,209,168 | A * | 5/1993 | Chapron | E05B 17/2084 109/59 T |
| 5,782,114 | A * | 7/1998 | Zeus | E05C 9/002 70/109 |
| 6,217,087 | B1 * | 4/2001 | Fuller | E05B 55/00 292/33 |
| 7,464,570 | B1 * | 12/2008 | Chen | E05B 43/005 109/59 R |
| 7,591,157 | B2 * | 9/2009 | O'Neill | E05C 9/06 292/32 |
| 7,661,279 | B2 * | 2/2010 | Huang | E05B 59/00 70/107 |
| 8,534,099 | B2 * | 9/2013 | Wheeler | E05B 15/102 70/100 |
| 2010/0327610 | A1 * | 12/2010 | Nakanishi | E05B 63/185 292/162 |
| 2013/0042657 | A1 * | 2/2013 | Dehaven | E05B 17/0062 70/1.5 |

FOREIGN PATENT DOCUMENTS

| | | | |
|---|---|---|---|
| CN | 102128001 | A | 7/2011 |
| CN | 203707594 | U | 7/2014 |
| CN | 104727695 | A | 6/2015 |
| CN | 204716009 | U | 10/2015 |
| DE | 19630677 | A1 | 2/1998 |
| DE | 202006001383 | U1 | 4/2006 |
| EP | 1561888 | A1 | 8/2005 |
| FR | 2926579 | A1 | 7/2009 |
| FR | 2934298 | A1 | 1/2010 |
| GB | 893520 | A | 4/1962 |
| JP | H6-47100 | Y2 | 11/1994 |
| KR | 10-1306899 | B1 | 9/2013 |
| WO | 2004022892 | A1 | 3/2004 |
| WO | 2004059114 | A1 | 7/2004 |
| WO | 2009087464 | A1 | 7/2009 |
| WO | 2016089298 | A1 | 6/2016 |

OTHER PUBLICATIONS

International Search Report (dated Aug. 31, 2017) for corresponding International App. PCT/SE2017/050592.
European Search Report (dated Nov. 12, 2019) for corresponding European App. 17807119.7.
Swedish International-type search report (dated Jan. 2, 2017) for corresponding Swedish App. 1650779-0.
ASSA Minikatalog 2015 [online], ASSA Abloy, 2015 [hamtad Dec. 20, 2016]. Hamtad fran internet: <http://www.assa.se/sv/site/assa/meny/sok/top-picks/minikatalog/>; sida 524-525; ASSA 2970, 4970.
Korean Official Action (dated Mar. 30, 2021) for corresponding Korean App. 10-2018-7038068.

* cited by examiner

LOCK CASSETTE AND SAFETY DOOR

BACKGROUND AND SUMMARY

The present invention relates to the general field of safety locking systems, and specifically to a lock cassette and a safety door.

Security storages are often placed outdoors and left unattended. Since a security storage may remain closed over long periods of time, the locking mechanism may corrode, which may ultimately lead to malfunctioning of the locking mechanism. The locking mechanism is generally built into the door of the safety storage, with the consequence that the locking mechanism cannot be repaired without dismantling the door of the safety storage, leaving the contents of the storage exposed during repairs. Repairing the locking mechanism on site requires transporting a large number of spare parts to the site, since the problem is generally unknown. Once the repair of the door has started, the safety storage cannot be left without leaving its content unguarded. The repairs can thus generally not be started one day and finished on another.

An ordinary door has a locking mechanism that is easy to replace, but such a solution is unfit for a safety storage. Security storages and similar spaces for storing items such as weapons, explosives and valuable materials require doors which can withstand illicit entry. One way of reinforcing a door is to include concrete and/or various metals in the door material.

However, this does not hinder illicit entries where the door is opened by tampering or damaging the locking system of the door. In some cases, the locking system is tampered with using keys and key-like objects, while in other cases the locking system is tampered with by drilling or other types of attack.

There is a need for a locking system than can be easily repaired. There is also a need for a locking system that does not unlock when it is tampered with.

The present invention relates, according to an aspect thereof, to a lock cassette, comprising: at least one lock bolt connecting piece, adapted for releasable engagement with a lock cassette engaging end portion of a door integrated lock bolt of a door when the lock cassette is mounted in a lock cassette receiving cavity of the door; a lock bolt maneuvering mechanism, configured to displace the at least one lock bolt connecting piece between an extended position and a retracted position, to thereby displace the lock bolt between an extended position and a retracted position; and at least one lock bolt locking arrangement, configured to lock the movability of the at least one lock bolt connecting piece when a locking action is effected, and unlock the movability of the at least one lock bolt connecting piece when an unlocking action is effected. When a locking action has been effected, and the movability of the lock bolt connecting piece is locked, the lock bolt connecting piece, and thereby the lock bolt, cannot be moved until an unlocking action is effected. Such a lock cassette can be mounted into a door comprising door integrated lock bolts and interact with these lock bolts. If there is a problem with the locking mechanism, the lock cassette can easily be removed and replaced with another similar lock cassette.

In embodiments, each lock bolt connecting piece is arranged to engage with the lock cassette engaging end portion of a corresponding door integrated lock bolt when the lock cassette is inserted into the cassette receiving cavity of the door in a direction perpendicular to the door integrated lock bolts. In embodiments, the lock bolt connecting piece is a plate with a cavity, and engages a groove in the lock cassette engaging end portion of the corresponding door integrated lock bolt in a fork like engagement. The other way around is also possible, so that the lock bolt connecting piece contains a groove, and the lock cassette engaging end portion comprises a cavity which engages the groove. Any type of releasable engagement between the lock bolt connecting piece and the lock cassette engaging end portion of a corresponding door integrated lock bolt is conceivable. This enables a simple yet effective engagement of the lock cassette with the lock bolts.

In embodiments, the lock cassette further comprises at least one cassette integrated lock bolt, configured to also be displaced by the lock bolt maneuvering mechanism between an extended position and a retracted position, wherein the movability of the cassette integrated lock bolt is also locked and unlocked by the lock bolt locking arrangement. This enables easy integration of an extra lock bolt into a safety door, in the position where the lock cassette is mounted.

In embodiments, the at least one lock bolt locking arrangement comprises a key receiving cavity configured to interact with a corresponding key, the locking action being the tuning of the key in one direction in the key receiving cavity, and the unlocking action being the turning of the key in the opposite direction in the key receiving cavity. The at least one lock bolt locking arrangement may e.g. comprise a lock bolt safety locking mechanism which is arranged to immobilize and permanently lock the movability of the at least one lock bolt connecting piece and any cassette integrated lock bolt when the key receiving cavity is tampered with. This means that the lock bolts are impossible to retract, and thus the door cannot be opened by simply destroying the locking system.

The lock bolt safety locking mechanism may e.g. comprise a biasing arrangement, a biasing releaser, and a connector, for example in the form of a wire, connecting the biasing arrangement to the biasing releaser. The biasing releaser may e.g. comprise a fragile material arranged to break when the key receiving cavity is tampered with, thereby releasing the biasing arrangement so that the lock bolt connecting pieces (and thereby the lock bolts) and any cassette integrated lock bolt become immobilized and permanently locked. The biasing arrangement may e.g. be spring biased, and may e.g. comprise two parallel springs. This is a simple yet effective embodiment of a tamper-proof locking system, but other embodiments are of course also possible, as long as the lock bolt safety locking system permanently locks the movement of the lock bolts when the key receiving cavity is tampered with.

In embodiments, the lock cassette comprises at least two lock bolt locking arrangements, each of which comprising a lock bolt safety locking mechanism. Each lock bolt locking arrangement may be connected to any number of lock bolt connecting pieces, and thereby to any number of lock bolts. Each lock bolt locking arrangement may comprise a key receiving cavity configured to interact with a corresponding key, which means that at least two keys are necessary for opening the door if there are at least two lock bolt locking arrangements. This makes the locking system safer.

In embodiments, the lock bolt maneuvering mechanism comprises a coupling which is rotatable around a rotation axis and operably connected to the lock bolt connecting piece, and also to any cassette integrated lock bolt, to translate a rotational movement of the coupling to a rectilinear movement of the lock bolts. The coupling may be operated from the outside of the cassette by a turning device. This makes it easy to open the door when the lock bolts are unlocked.

In embodiments, the lock bolt maneuvering mechanism is electronically operated based on a received signal. The signal may be triggered at least partly by the locking and unlocking actions, such as the turning of the key in the key receiving cavity. This enables automatic opening of the door as soon as it has been unlocked, without manual actuation of the lock bolt maneuvering mechanism.

The present invention further relates to a safety door comprising a lock cassette receiving cavity adapted for receiving an exchangeable lock cassette, and at least one door integrated lock bolt having a wall engaging end portion and a lock cassette engaging end portion. Such a safety door is easy to repair by exchanging the exchangeable lock cassette.

The present invention further relates to a safety door comprising a lock cassette receiving cavity, the above described lock cassette inserted into the lock cassette receiving cavity, and at least one door integrated lock bolt having a wall engaging end portion and a lock cassette engaging end portion, wherein each lock bolt connecting piece of the lock cassette is engaged with a corresponding lock cassette engaging end portion of the door integrated lock bolt. Such a safety door is easy to repair by removing the lock cassette and replacing it with another similar lock cassette.

In embodiments, the safety door comprises at least two door integrated lock bolts. This makes the safety door safer.

The scope of the invention is defined by the claims, which are incorporated into this section by reference. A more complete understanding of embodiments of the invention will be afforded to those skilled in the art, as well as a realization of additional advantages thereof, by a consideration of the following detailed description of one or more embodiments.

Reference will be made to the appended sheets of drawings that will first be described briefly.

BRIEF DESCRIPTION OF THE DRAWINGS

The invention is explained in detail below with reference to the accompanying drawings, in which.

Embodiments of the present disclosure and their advantages are best understood by referring to the detailed description that follows. It should be appreciated that like reference numerals are used to identify like elements illustrated in one or more of the figures.

DETAILED DESCRIPTION

Figure 1:
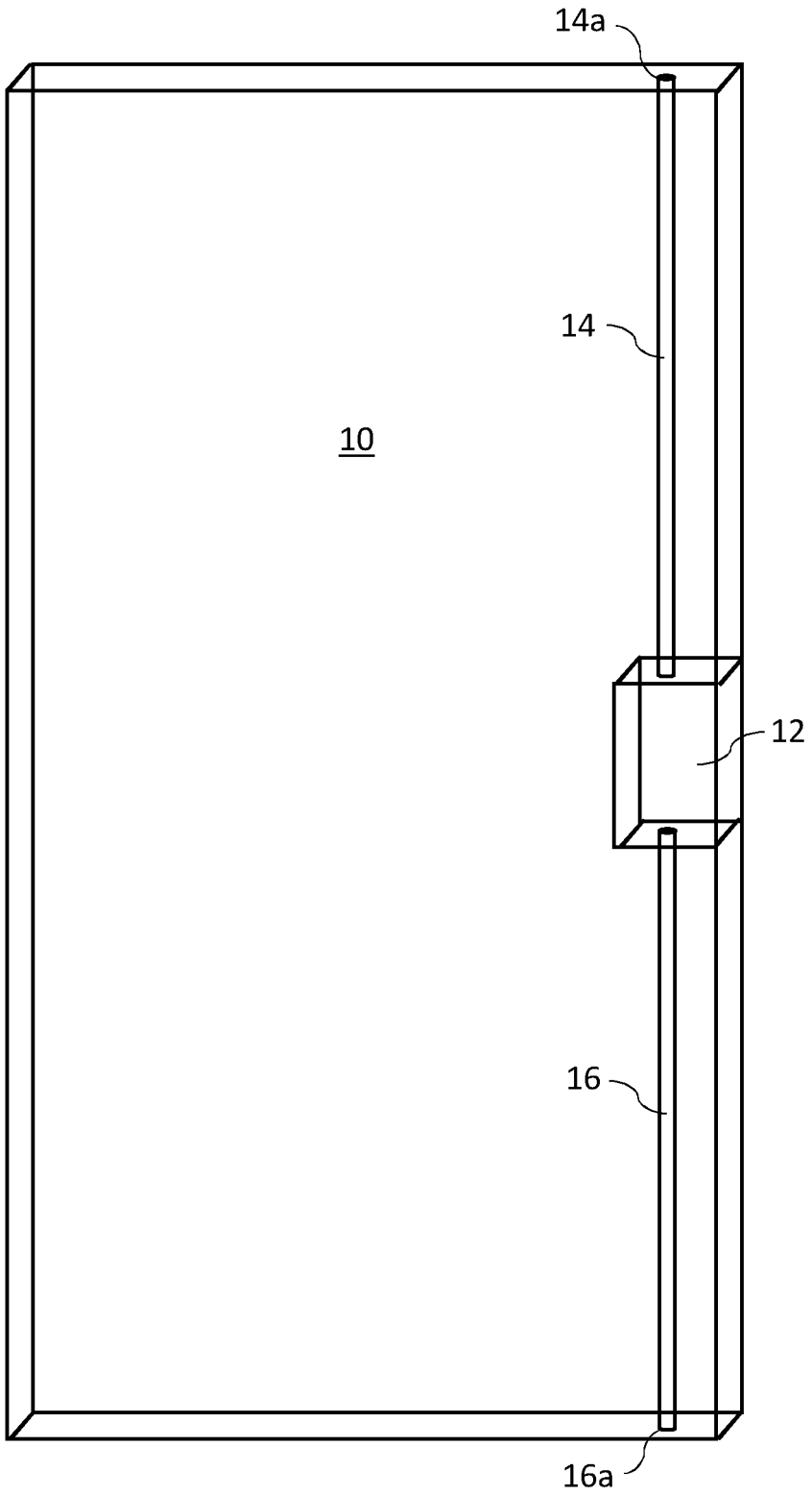
FIG. 1 shows a schematic view of a door comprising a lock cassette receiving cavity and two door integrated lock bolts according to embodiments of the invention.

Referring to the drawings, there is illustrated one specific exemplifying embodiment of a locking system in accordance with the inventive concept. Other embodiments are of course conceivable within the scope of the invention.

FIG. 1 shows a schematic view of a door 10 comprising a lock cassette receiving cavity 12 and two door integrated lock bolts 14, 16 according to embodiments of the invention. The door integrated lock bolts 14, 16 have wall engaging end portions 14*a*, 16*a* configured to engage with the wall around the door when the door is locked. The wall engaging end portions 14*a*, 16*a* are adapted to engage with cavities arranged in any part of the wall or door frame surrounding the actual openable door 10. In embodiments, the door 10 is mounted in e.g. a concrete wall comprising cavities for receiving the wall engaging end portions 14*a*, 16*a* of the door integrated lock bolts 14, 16. In embodiments, the door 10 is mounted in a door frame comprising cavities for receiving the wall engaging end portions 14*a*, 16*a* of the door integrated lock bolts 14, 16, which door frame is mounted in a wall. In the lock cassette receiving cavity 12, a lock cassette 20 can be mounted.

Figure 2:
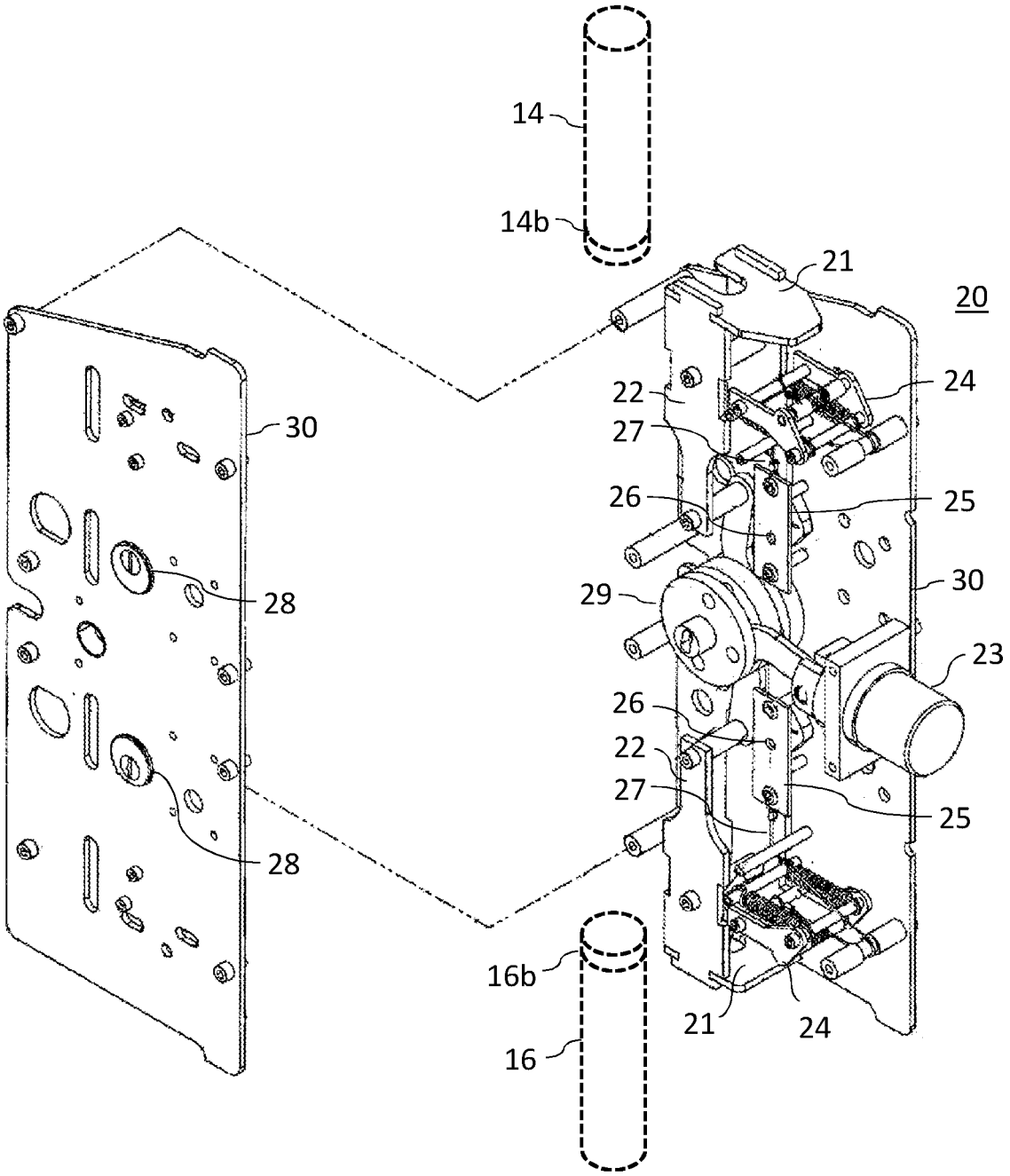
FIG. 2 shows a partly exploded view of a lock cassette according to embodiments of the invention.

FIG. 2 shows a partly exploded view of a lock cassette 20 according to embodiments of the invention. The shown lock cassette 20 comprises a cassette integrated lock bolt 23. Lock bolt connecting pieces 21 in the form of plates with cavities engage with grooves in the lock cassette engaging end portions 14*b*, 16*b* of the schematically shown door integrated lock bolts 14, 16 in a fork like engagement when the lock cassette 20 is inserted into the cassette receiving cavity 12 of the door 10 in a direction perpendicular to the door integrated lock bolt 14, 16. For a vertical door 10 with the lock cassette receiving cavity 12 positioned on the side, insertion in a direction perpendicular to the door integrated lock bolt 14, 16 is a lateral insertion, but for other types of doors, such as hatches, insertion in a direction perpendicular to the door integrated lock bolt 14, 16 maybe e.g. a vertical insertion.

Other types of releasable engagement of the lock bolt connecting pieces 21 with the lock cassette engaging end portions 14*b*, 16*b* of the door integrated lock bolts 14, 16 are of course conceivable. For example, the lock bolt connecting pieces 21 may contain grooves, and the lock cassette engaging end portions 14*b*, 16*b* may comprise cavities which engage the grooves. In another example, the lock bolt connecting pieces 21 comprise rods which are inserted into holes in the corresponding lock cassette engaging end portions 14*b*, 16*b*.

The lock cassette comprises a lock bolt maneuvering mechanism, configured to displace the lock bolt connecting pieces 21 (and thereby the door integrated lock bolts 14, 16) and the cassette integrated lock bolt 23 between an extended position and a retracted position. The lock cassette further comprises two lock bolt locking arrangements, configured to lock the movability of the lock bolt connecting pieces 21 (and thereby the door integrated lock bolts 14, 16) and the cassette integrated lock bolt 23 when a locking action is effected, and unlock the movability of the lock bolt connecting pieces 21 (and thereby the door integrated lock bolts 14, 16) and the cassette integrated lock bolt 23 when an unlocking action is effected. The locking of the movability means that the lock bolts 14, 16, 23 cannot be moved until an unlocking action has been effected.

Each of the lock bolt locking arrangements comprises a key receiving cavity 26 configured to interact with a corresponding key. The locking action is thus the turning of the key in one direction in the key receiving cavity 26, and the unlocking action is the turning of the key in the opposite direction in the key receiving cavity 26. The shown lock cassette 20 comprises two keyholes 28, arranged on the outside of the cassette, which are aligned with the key receiving cavities 26.

Each of the lock bolt locking arrangements comprises a lock bolt safety locking mechanism which is arranged to immobilize and permanently lock the lock bolt connecting pieces 21 (and thereby the door integrated lock bolts 14, 16) and the cassette integrated lock bolt 23 when the key receiving cavity 26 is tampered with. Each of the shown lock bolt safety locking mechanisms comprises a biasing arrangement 24, a biasing releaser 25, and a connector 27, for example in the form of a wire, which connects the biasing arrangement 24 to the biasing releaser 25. The biasing releaser 25 may comprise or be configured of a fragile material such as glass, preferably a sheet of glass. It may be arranged to break when the key receiving cavity is tampered with, thereby releasing the biasing arrangement 24 so that the lock bolt connecting pieces 21 (and thereby the door integrated lock bolts 14, 16) and the cassette integrated lock bolt 23 become immobilized and permanently locked. The permanent locking means that the lock bolts 14, 16, 23 cannot be moved even if an unlocking action is effected. The shown biasing arrangement 24 comprises two parallel springs, but many different types of biasing arrangements are of course conceivable.

In the shown embodiment, the two keyholes 28 are aligned with two lock bolt locking arrangements and two biasing releasers 25, and arranged on the outside of the door.

Additionally, the connector 27 is in contact with one or more rods having the function of pulleys which help to configure the components with space efficiency within the casing, provide a free passage for the connector when the lock releaser breaks due to tampering and distribute biasing spring force in the connector to enable a stronger spring force being retained by the biasing releaser 25.

Figure 3A:
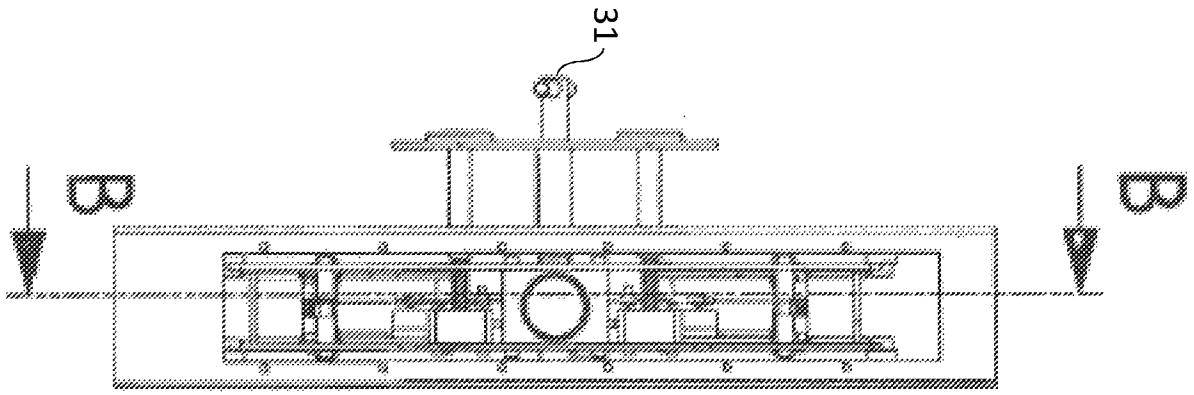
FIG. 3*a* shows a side view of the lock cassette of FIG. 2.
Figure 3B:
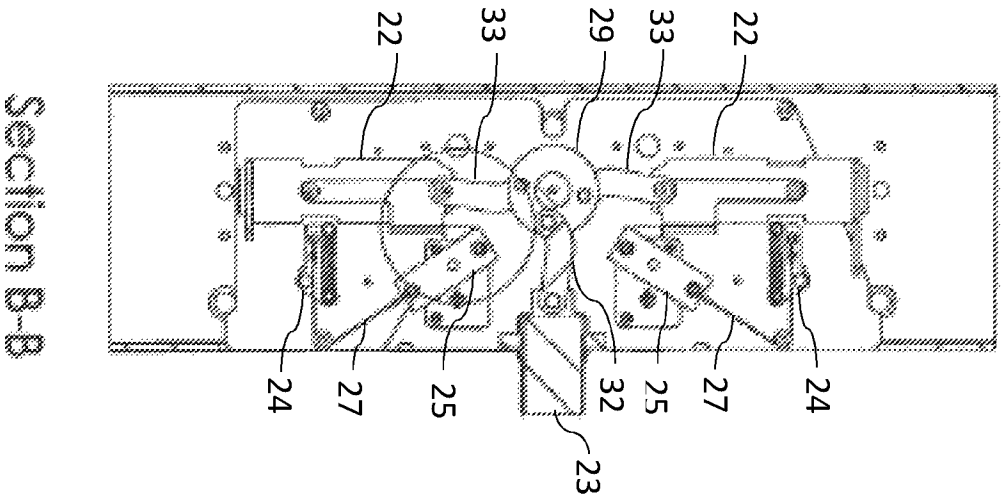
FIG. 3*b* shows a view of a cross-section B-B in FIG. 3*a*.

The shown lock bolt maneuvering mechanism comprises a coupling 29 which is rotatable around a rotation axis and operably connected to the lock bolts 14, 16, 23 to translate a rotational movement of the coupling 29 to a rectilinear movement of said lock bolts 14, 16, 23. As shown in FIG. 3*a*, the coupling 29 is operated from the outside of the cassette by a turning device 31 which can be rotated by an operator. Moreover, as shown in FIG. 3*b*, the coupling 29 is operably connected to the cassette integrated lock bolt 23 with a first lock bolt arm 32, which is arranged perpendicularly in relation to the rotation axis. Additionally, the first lock bolt arm 32 is at its respective ends supported at pivotal joints disposed on the coupling 29 and on the cassette integrated lock bolt 23.

In embodiments, the lock bolt maneuvering mechanism is electronically operated based on a received signal. The signal may e.g. be triggered at least partly by the locking and unlocking actions, so that the door may open automatically as soon as it has been unlocked.

In the shown embodiment, each lock bolt connecting piece 21 is connected to the coupling 29 via a locking latch 22 and a locking latch arm 33. The locking latch arm 33 is operably connected to the locking latch 22 to translate a rotational movement of the coupling 29 to a rectilinear movement of the locking latch 22, and thereby a rectilinear movement also of the lock bolt connecting piece 21. The locking latch 22 is arranged perpendicularly in relation to the rotation axis of the coupling 29, and the lock bolt locking arrangement is configured to be able to lock the movability of the locking latch 22, thereby locking the movability of the coupling 29 and also of the cassette integrated lock bolt 23. The shown embodiment comprises two lock bolt locking arrangements, as well as two locking latches 22 and two locking latch arms 33 engaging the respective locking latch 22.

In the shown embodiment, the biasing arrangement 24 comprises a symmetric pair of spring biased safety locking rods, configured to be able to lock the movability of the locking latch 22 and thus the lock bolt connecting piece 21. Consequently, when the lock bolt locking arrangement is tampered with, the biasing releaser 25 breaks. The springs are then released and force the safety locking rods into a recess in the locking latch 22, thereby locking the movability of the locking latch 22 and thus the lock bolt connecting piece 21. Consequently, the coupling 29, and thereby the bolts 14, 16, 23, are immobilized and permanently locked, i.e. it is thereafter not possible to unlock the locking system with operator keys. Instead, the door has to be demounted and/or destroyed in order to enter the space protected by the door.

The shown embodiment comprises two locking latches 22, each provided with an associated safety locking mechanism configured as described above. Each locking latch is connected with a corresponding connecting piece 21, connecting the locking latch 22 to the door integrated lock bolts 14, 16 so that the door integrated lock bolts 14, 16 move simultaneously with the cassette integrated lock bolt 23. The connecting piece 21 is the interface between the lock cassette 20 and the door integrated lock bolts 14, 16.

The shown lock cassette 20 comprises a casing having two preferably symmetric side plates 30 provided with recesses providing guides for moving parts within the casing, shoulders for fixed parts within the casing and screws for assembling the casing.

The locking system according to the present invention can be made in a variety of sizes. One of ordinary skill in the art will understand that a variety of sizes are possible without compromising the utility of the locking system.

The lock cassette may comprise any number of lock bolts, lock bolt connecting pieces and lock bolt locking arrangements, e.g. one, two, three or four. There may be just one lock bolt locking arrangement even if there are several lock bolts, and there may be several lock bolt locking arrangements even if there is only one lock bolt and/or lock bolt connecting piece.

The locking system according to the present invention may be utilized in any type of door, such as regular vertical doors or doors in the form of hatches mounted in any direction.

Particularly, the locking system is used in doors which aim to hinder illicit entries such as illicit entries to rooms and spaces where explosives, weapons and valuables are being stored. One of ordinary skill in the art will understand that there are a variety of doors, as well as other types of arrangements for keepings materials locked, where the locking system according to the present invention can be deployed.

While the locking system according to the present invention has been described with reference to the above specific examples, this is intended to be illustrative only and not to be limiting of the disclosure, it is noted that changes, additions and/or deletions may be made to the disclosed examples without departing from the spirit and scope of the disclosure. The scope of the disclosure is therefore not covered by any specific example, but rather by the following claims.

The foregoing disclosure is not intended to limit the present invention to the precise forms particular fields of use disclosed. It is contemplated that various alternate embodiments and/or modifications to the present invention, whether explicitly described or implied herein, are possible in light of the disclosure. Accordingly, the scope of the invention is defined only by the claims.

The invention claimed is:

1. A lock cassette comprising:

at least one lock bolt connecting piece, adapted for releasable engagement with a lock cassette engaging end portion of a door integrated lock bolt of a door when the lock cassette is mounted in a lock cassette receiving cavity of the door;

a lock bolt maneuvering mechanism comprising a coupling rotatable about a rotation axis and linked to the at least one lock bolt connecting piece by a locking latch and configured to displace the at least one lock bolt connecting piece between an extended position and a retracted position, to thereby displace the lock bolt between an extended position and a retracted position; and at least one lock bolt locking arrangement, configured to lock the movability of the at least one lock bolt connecting piece when a locking action is effected, and unlock the movability of the at least one lock bolt connecting piece when an unlocking action is effected, wherein the at least one lock bolt locking arrangement comprises a key receiving cavity configured to interact with a corresponding key, a locking action being a turning of the key in one direction in the key receiving cavity, an unlocking action being a turning of the key in an opposite direction from the one direction in the key receiving cavity, wherein the at least one lock bolt locking arrangement comprises a lock bolt safety locking mechanism, the lock bolt safety locking mechanism being arranged to lock mobility of the locking latch and thereby immobilize and permanently lock a movability of the at least one lock bolt connecting piece and any cassette integrated lock bolt when the key receiving cavity is tampered with, wherein the locking latch and a locking latch arm form a hinged linkage connected at one end to the coupling, the coupling moving the lock bolt connecting piece when the coupling is turned, and wherein the coupling is rotatable around a rotation axis and operably connected to the lock bolt connecting piece via the hinged linkage to translate a rotational movement of the coupling to a rectilinear movement of the lock bolt connecting piece.

2. A lock cassette according to claim 1, wherein each lock bolt connecting piece is arranged to engage with the lock cassette engaging end portion of a corresponding door integrated lock bolt when the lock cassette is inserted into the cassette receiving cavity of the door in a direction perpendicular to the door integrated lock bolt.

3. A lock cassette according to claim 2, wherein the lock bolt connecting piece comprises a plate with a cavity, and engages a groove in the lock cassette engaging end portion of the corresponding door integrated lock bolt in a fork like engagement.

4. A lock cassette according to claim 1, further comprising at least one cassette integrated lock bolt, configured to be displaced by the lock bolt maneuvering mechanism between an extended position and a retracted position, wherein the movability of the cassette integrated lock bolt is locked and unlocked by the lock bolt locking arrangement.

5. A lock cassette according to claim 1, wherein the lock bolt safety locking mechanism comprises a biasing arrangement, a biasing releaser, and a connector connecting the biasing arrangement to the biasing releaser.

6. A lock cassette according to claim 5, wherein the biasing releaser comprises a fragile material arranged to break when the key receiving cavity is tampered with, thereby releasing the biasing arrangement so that the lock bolt connecting pieces and any cassette integrated lock bolt become immobilized and permanently locked.

7. A lock cassette according to claim 6, wherein the biasing arrangement is spring biased.

8. A lock cassette according to claim 7, wherein the biasing arrangement comprises two parallel springs.

9. A lock cassette according to claim 1, comprising at least two lock bolt locking arrangements, each of which comprising the lock bolt safety locking mechanism.

10. A lock cassette according to claim 1, wherein the coupling is operated from the outside of the cassette by a turning device.

11. A lock cassette according to claim 1, wherein the lock bolt maneuvering mechanism is electronically operated based on a received signal.

12. A lock cassette according to claim 11, wherein the signal is triggered at least partly by the locking and unlocking actions.

13. A safety door, comprising a lock cassette receiving cavity, a lock cassette according to claim 1 inserted into the lock cassette receiving cavity, and at least one door integrated lock bolt having a wall engaging end portion and a lock cassette engaging end portion, wherein each lock bolt connecting piece of the lock cassette is engaged with a corresponding lock cassette engaging end portion of the door integrated lock bolt.

14. A safety door according to claim 13, comprising at least two door integrated lock bolts.

* * * * *